US005860800A

United States Patent [19]

Kramer et al.

[11] Patent Number: 5,860,800

[45] Date of Patent: Jan. 19, 1999

[54] COMPRESSOR CYLINDER HEAD HAVING A PARTITION

[75] Inventors: Manfred Kramer, Barsinghausen; Heinrich Schlossarczyk, Wennigsen; Karl-Heinrich Schönfeld, Seelze, all of Germany

[73] Assignee: WABCO Vermogensverwaltungs GmbH, Hanover, Germany

[21] Appl. No.: 542,344

[22] Filed: Oct. 12, 1995

[30] Foreign Application Priority Data

Oct. 13, 1994 [DE] Germany ..... 44 36 557.8
Sep. 21, 1995 [DE] Germany ..... 195 35 079.0

[51] Int. Cl.[6] ..... F04B 39/10

[52] U.S. Cl. ..... 417/571; 92/144; 165/185

[58] Field of Search ..... 92/144; 165/185; 417/540, 542, 571

[56] References Cited

U.S. PATENT DOCUMENTS 2,309,833 2/1943 Elze ..... 417/571
2,463,766 3/1949 Hadley ..... 417/571

FOREIGN PATENT DOCUMENTS 809 841 8/1951 Germany .
1050496 2/1954 Germany .
2101051 9/1971 Germany .
28 26 744 1/1980 Germany .
29 45 727 C2 7/1980 Germany .
30 46 434 A1 7/1982 Germany .
39 09 176 A1 9/1990 Germany .

*Primary Examiner*—Charles G. Freay
*Attorney, Agent, or Firm*—Proskauer Rose LLP

[57] ABSTRACT

A compressor with a cylinder head (33, 29) comprises a lower cylinder head section (33) and an upper cylinder head section (29) connected to each other. A seal (12) is provided between the faces of the lower cylinder head section (33) and the upper cylinder head section (29) facing each other. A suction space (31, 25) and a pressure space (10, 17) as well as a suction valve (32, 4) and a pressure valve (5, 7) are installed in the cylinder head (33, 29). A compression space (3) of the compressor is connected by the suction valve (32, 4) to the suction space (31, 25), and by the pressure valve (5, 7) to the pressure space (10, 17). The suction space (31, 25) is also connected by a suction connection (71) to the atmosphere, and the pressure space (10, 17) is connected to a consumer by a pressure connection (18) to a source of pressure. In order to achieve efficient transfer of heat in the cylinder head (33, 29), a wall-like part (76), made of a material with good heat transferring properties, is provided at least in the pressure space (10, 17) to subdivide the pressure space (10, 17) of the cylinder head (33, 29) into a first pressure chamber (10) and a second pressure chamber (17). The first pressure chamber (10) and the second pressure chamber (17) are connected to each other by a passage opening (77) located in the wall-like part (76). Desirably, the suction space (31,15) is subdivided into first and second suction chambers (31,15) by a U-shaped part (79,80) having a second passage opening (78).

35 Claims, 6 Drawing Sheets

COMPRESSOR CYLINDER HEAD HAVING A PARTITION

FIELD OF THE INVENTION

The present invention relates to a compressor. More particularly, the present invention relates to reciprocating compressors with flow deflectors.

BACKGROUND OF THE INVENTION

A compressor of this type is known from DE-OS 28 26 744. This known compressor has ridges located in the cylinder head. The ridges extend into a pressure space and form chambers or channels extending from a pressure valve opening through which the major portion of the compressed air is forced and conveyed, by single or multiple deflections, into a pressure connection of the compressor. By taking the compressed air past the ridges, the compressed air is cooled, thereby reducing the temperature at the cylinder head.

It is the object of the invention to provide an improved compressor with even better cooling of the air conveyed by the compressor.

SUMMARY OF THE INVENTION

The present invention provides a large cooling surface for the air conveyed by the compressor without major changes to cylinder head of the compressor.

The increased cooling capacity is possible because a plate-shaped seal is positioned at a right angle to the longitudinal axis of the cylinder head. This seal is placed in such a manner that it subdivides the pressure space into a first pressure chamber and a second pressure chamber. The two pressure chambers are connected to each other by a passageway opening in the seal. The compressed air that is conveyed by the compressor remains in the pressure space for a longer period of time, allowing for additional cooling of the compressed air. Suitable configurations of the plate-shaped seal and suitable placement of the passageway opening in the plate-shaped seal, make it possible to convey the compressed air effectively to locations in the cylinder head that are especially well cooled.

In an alternate embodiment of the present invention, a plate-shaped part not only subdivides the pressure space but also the suction space of the compressor into two chambers. The two chambers in the suction space are connected to each other by an additional passageway opening in the plate-shaped part. If the plate-shaped part is made of a material which transfers heat efficiently, the air in the compressor is cooled quickly and to lower temperatures. This seal arrangement also reduces the noise emitted by the compressor. Through suitable placement of the passageway openings in the plate-shaped parts, the air can be conveyed easily to those locations of the cylinder head which become especially warm.

In another embodiment of the present invention, the plate-shaped part is formed by the seal installed between the upper cylinder head section and the lower cylinder head section. For this purpose, the seal is made in the form of a plate-shaped part which extends from a point where the part is clampingly held between the upper cylinder head section and the lower cylinder head section, into the pressure space. So situated, the plate-shaped part is at a right angle to the longitudinal axis of the upper cylinder head section and the lower cylinder head section. The pressure space is thereby divided by the seal into a first pressure chamber on the side of the pressure valve and a second pressure chamber on the side of the pressure connection. These two pressure chambers are connected to each other by a passage opening delimited by the seal or located in the seal.

According to another embodiment of the present invention, the seal extends into the spaces or channels of the compressor and divides it into first and second chambers. Coolant flows through the seal. This measure makes it possible to achieve especially good heat transfer to the coolant. Because the coolant channel is divided into two chambers by the seal, and the chambers are then connected to each other, an airflow in the coolant is created, counteracting the formation of air bubbles in the coolant channels.

According to another embodiment of the present invention, either the upper cylinder head section or the lower cylinder head section is further divided at a right angle to the longitudinal axis of the cylinder head. In either the upper cylinder head section or the lower cylinder head section, an additional plate-shaped part is provided so that either the second pressure chamber on the side of the pressure connection, or the first pressure chamber of the pressure space on the side of the pressure valve, or also the first suction chamber on the side of the suction connection or, the second suction chamber of the suction space on the suction valve side, is subdivided into several chamber sections which are connected to each other by the passage openings in the plate-shaped parts. If the seal that is installed between the sections of the upper cylinder head section or the lower cylinder head section is made in the shape of a plate, this plate-shaped seal is clampingly held between the faces of the two upper cylinder head sections or lower cylinder head section facing each other. The additional plate-like seal extends at least into the second pressure chamber on the side of the pressure connection, or into the first pressure chamber on the pressure valve connection, subdividing it into a first chamber section and into a second chamber section. The two chamber sections are connected to each other by a passage opening delimited by the additional seal or located in the additional seal. The pressure valve and the passage opening either of the first seal or of the first plate-shaped part, as well as the passage opening of the second seal or of the second plate-shaped part, are offset in relation to each other. The two plate-shaped seals or plate-shaped parts with the passage openings they delimit thus constitute a labyrinth through which the compressed air coming from the pressure valve is conveyed to the pressure connection.

According to another embodiment of the present invention, it is also possible to configure and size the second seal so that it extends into a suction chamber of the suction space and into a cooling chamber of a cooling space, or into a chamber of some other space. The second seal thus subdivides the suction space and cooling chamber into chamber sections which are connected to each other via passage openings in the seal.

Seven embodiments of the present invention are explained below in further detail through the drawings.

DETAILED DESCRIPTION OF THE INVENTION

Figure 1:
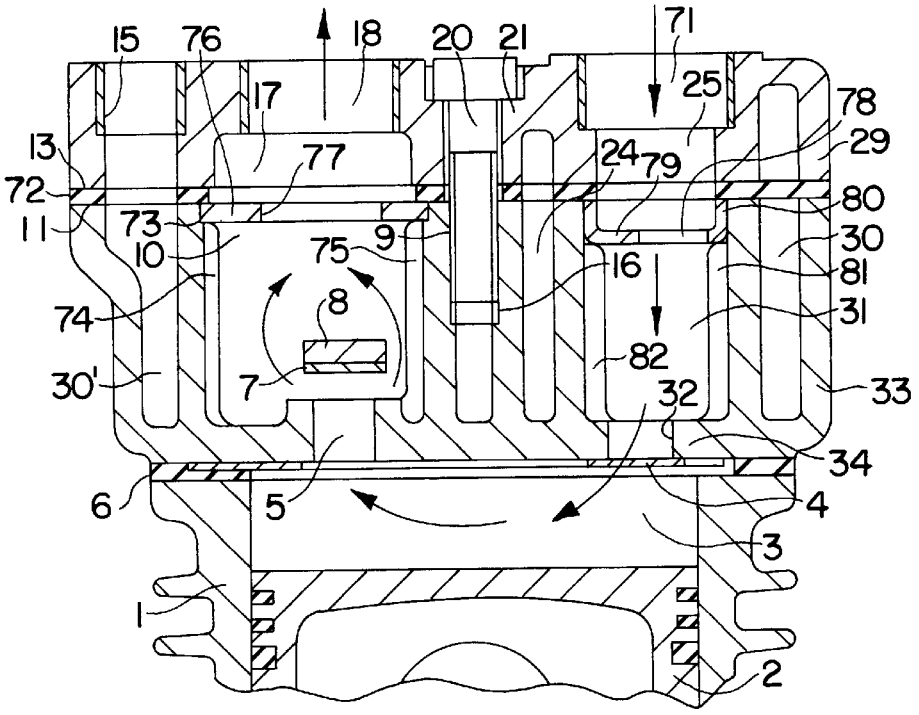
FIG. 1 shows a longitudinal section through a cylinder head of a compressor containing the plate-shaped parts according to the present invention, whereby the one plate-shaped part subdivides the pressure space and the other plate-shaped part subdivides the suction space into a first chamber and into a second chamber.

According to FIG. 1, a piston (2) is provided in a cylinder (1) of a compressor for the production of compressed air. The piston is capable of moving in the direction of the longitudinal axis of the cylinder (1). The cylinder (1) has a compression space (3) which is delimited on the one hand by the piston (2), and on the other hand by a cylinder head (33, 29). The cylinder (1) and the cylinder head (33, 29) are connected to each other by connecting means (not shown) such as screws or stud bolts. A cylinder head seal (6) is installed between the sides of cylinder head (33, 29) and cylinder (1), which are facing each other.

The cylinder head (33, 29) is divided at a right angle to the longitudinal axis of the cylinder (1) to form a lower cylinder head section (33) and an upper cylinder head section (29). The upper cylinder head section (29) serves as a cylinder head cover. The upper cylinder head section (29) and the lower cylinder head section (33) are detachably connected to each other by means of screws (20) which are screwed into threads (16) of the bores (9) in the cylinder head (33, 29). The side of the lower cylinder head section (33) toward the cylinder has a bottom (34) in which a first passage (32) and a second passage (5) are provided. The first passage (32), together with an elastic tongue-like element serving as a valve closing element (4) that is clampingly held at one end between cylinder (1) and lower cylinder head section (33), constitute a suction valve (32, 4) through which the compression space (3) can be connected to a suction space (31, 25) located in the cylinder head (33, 29). The second passage (5), together with an elastic valve closing element (7) attached on the bottom of the cylinder head, constitute a pressure valve (5, 7) through which the compression space (3) can be connected to a pressure space (10, 17) located in the cylinder head. The valve closing element (7) of the pressure valve (5, 7) is located in the pressure space (10, 17). The opening stroke of the valve closing element (7) of the pressure valve (5, 7) is limited by a valve catcher (8) which is also located in the pressure space (10, 17). The pressure space (10, 17) and the suction space (31, 25) are separated from each other by means of a wall (21) located in the cylinder head (33, 29). The suction space (31, 25) is connected to the atmosphere via a suction connection (71) installed on the cylinder head (33, 29). The pressure space (10, 17) is connected to a consumer via a pressure connection (18) provided on the cylinder head (33, 29). Coolant spaces (30, 24, 30') in the form of channels are provided in the walls of cylinder head (38, 29) which surround or delimit the pressure space (10, 17) and the suction space (31, 25). These channels are connected to each other and are connected by a coolant connection (15) to a coolant source of gaseous or fluid coolants. The coolant spaces (30 and 30') are made in the form of a cohesive channel located in the casing of the cylinder head (29, 30).

A flat seal (72) is clampingly held between the face (11) of the lower cylinder head section (33) that is turned towards the upper cylinder head section (29), and the face (13) of the upper cylinder head section (29) that is turned towards the lower cylinder head section (33). In the area of the pressure space (10, 17), of the suction space (25, 31), and of the coolant spaces (30, 24, 30'), the flat seal (72) is provided with openings which uncover these spaces.

On its side towards the upper cylinder head section (29), the wall of the lower cylinder head section (33) delimiting the pressure space (10, 17) is provided with a surrounding shoulder (73) and with several projections in the form of ribs (74, 75) which are flush with the shoulder. The ribs (74, 75) extend in the direction of the longitudinal axis of the cylinder head (29, 33) and include portions which extend at a right angle to the longitudinal axis of said cylinder head (29, 33) into the pressure space (10, 17). A wall-like part, or partition formed by a plate (76), lies on the shoulder (73) and on the face towards the upper cylinder head section (29) of the ribs (74, 75) which are flush with the shoulder (73). The thickness of the plate (76) is selected so that, with its side towards the upper cylinder head section (29), it either lies flush with the face (11) of the lower cylinder head section (33) towards the upper cylinder head section (29), or it extends slightly beyond this face (11). Because of the shoulder (73) and the outer diameter of the plate (76) which is greater than the diameter of the pressure space (10, 17), the border area of the plate (76), is covered by a portion of the flat seal (72). When the lower cylinder head section (33) and the upper cylinder head section (29) have been connected to each other, and the flat seal (72) is prestressed, the plate (76) is held in this manner on the shoulder (73) of the wall of the lower cylinder head section (33) delimiting the pressure space (10, 17). The plate (76) is placed at a right angle to the longitudinal axis of the cylinder head (29, 33) and extends into the pressure space (10, 17) in such a manner that it subdivides the pressure space (10, 17) into a first pressure chamber (10), located on the side of the pressure valve and into a second pressure chamber (17), located in the upper cylinder head section (29).

In a similar manner, the suction space (31, 25) is subdivided by a wall-like part, or partition that extends at a right angle to the longitudinal axis of the cylinder head (29, 33) and is located in the suction space (31, 25). This part is formed by a U- or pot-shaped part (79, 80) that subdivides the suction space into a first suction chamber (25) located on the side of the suction connection, and a second suction chamber (31), located in the lower cylinder head section (33) on the side of the suction valve (32, 4).

The pot-shaped part (79, 80) has a bottom (79) and a casing (80). It is positioned in such a manner within the suction space (31, 25) that it lies with the outer edges of its bottom (79) on the face of the ribs (81, 82) towards the upper cylinder head section (29). Said ribs (81, 82) extend in the direction of the longitudinal axis of the cylinder head (29, 33), and are located on the wall of the lower cylinder head section (33) delimiting the suction space (25, 31). The ribs (81, 82) also include portions which extend at a right angle to the longitudinal axis of the cylinder head (29, 33) into the suction space (25, 31). The casing (80) of the pot-shaped part (79, 80) presses with its outer surface against the wall of the lower cylinder head section (33) delimiting the suction space (25, 31). The face of the casing (80) of the pot-shaped part (79, 80) that is away from the bottom (79) extends in the direction of the upper cylinder head section (29). It is either flush with the face (11) of the lower cylinder head section (33) towards the upper cylinder head section (29), or it extends slightly beyond this face (11). The flat seal (72) is designed, in the area of the suction space (25, 31), in such a manner that it extends for a certain distance into the suction space so that it covers the face of the casing (80) of the pot-shaped part (79, 80) towards itself. In this manner, the pot-shaped part (79, 80) is also held on the face of the ribs (81, 82) after the connection of the lower cylinder head section (33) and the upper cylinder head section (29) to each other, while the flat seal (72) is prestressed.

The first pressure chamber (10) is connected to the second pressure chamber (17) by a first passage opening (77) provided in the plate (76). Similarly, the first suction chamber (25) is connected to the second suction chamber (31) by a second passage opening (78) in the bottom (79) of the pot-shaped part (79, 80).

Figure 2:
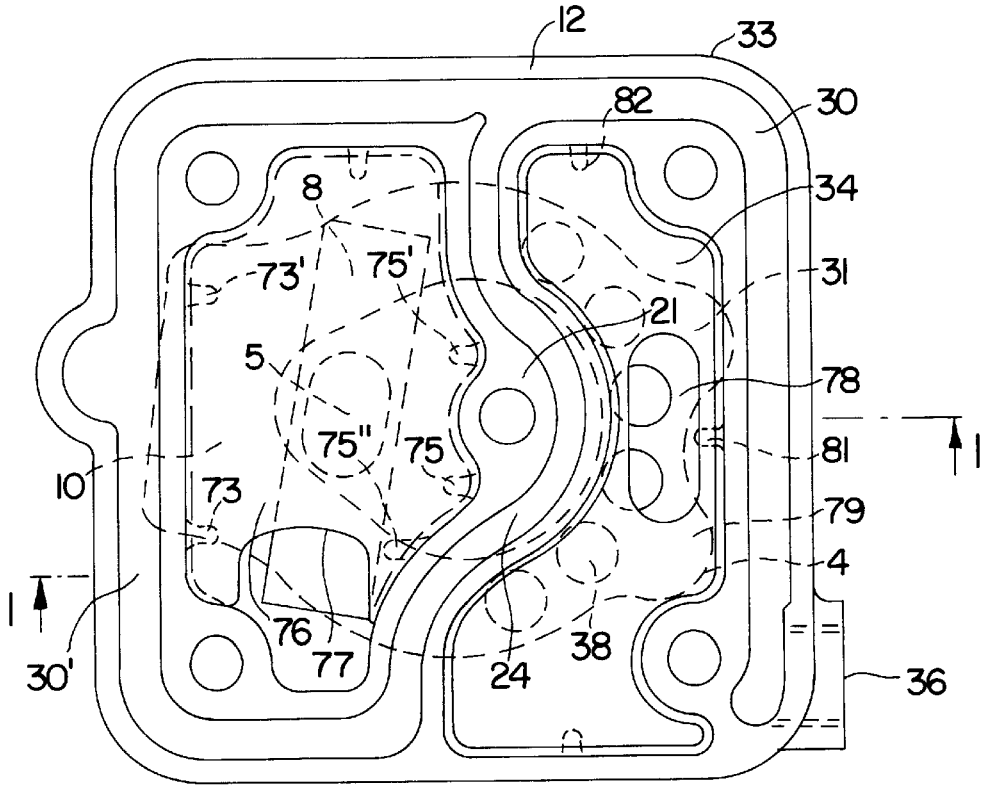
FIG. 2 is a top view of the cylinder head according to FIG. 1, with the upper cylinder head section removed.

FIG. 2 shows a top view of the cylinder head of the compressor according to FIG. 1, with the upper cylinder head section removed. For the sake of clarity, the components which are identical with the components shown in FIG. 1 are given the same reference numbers.

The lower cylinder head section contains the first pressure chamber (10) and the second suction chamber (31), as well as the first coolant chambers (30, 30') in the form of channels. The first pressure chamber (10) is covered by the plate (76) which lies on the ribs (73, 73', 75, 75', 75"). As can be easily seen in the drawing, the passage opening (77) located in the plate (76) that connects the first pressure chamber (10) to the second pressure chamber (17) of the pressure space has a relatively small diameter, so that the major portion of the first pressure chamber (10) of the pressure space is covered by the plate (76). The passage opening (5), and the valve catcher (8) of the pressure valve (5, 7) in the bottom (34) of the lower cylinder head section (33), are represented by broken lines. The second suction chamber (31) of the suction space which is also located in the lower cylinder head section that is covered by the pot-shaped part (79, 80) supported on the ribs (81, 82), is connected to the first suction chamber (25) located in the upper cylinder head section via the passage opening (78) in the bottom (79) of the pot-shaped part (79, 80). The passage opening (78) in the pot-shaped part (79, 80) has a much larger passage cross-section than the passage opening (77) in the plate (76). In order to avoid losses due to suction or throttling, the cross-section of the bottom (79) of the pot-shaped part (79, 80) must be at least as large as, or even larger than, the cross section of the passage of the suction connection.

The bottom (34) of the lower cylinder head section (33) is provided with several passage openings (32, 38) which, together with the tongue-like valve closing element (4), constitute the suction valve (32, 38, 4). The first coolant chambers (30, 30'), in the form of a channel which partially surrounds the pressure space and the suction space, is provided in the casing of the cylinder head (33). It is connected by the coolant connection (36) to the source of coolant. The additional coolant space (24), in the form of a coolant channel and installed in the wall (21) of the cylinder head, is connected to the coolant chambers (30, 30') installed in the casing of the cylinder head, so that these two coolant chambers (30, 30', 24) surround both the pressure space and the suction space, practically in the form of a ring. The view of the cylinder head shown in FIG. 1 is a cross-section through the cylinder head along the section line 1—1 in FIG. 2. The function of the seal shown in the above figures is explained below in further detail.

During a suction stroke of the piston (2), the suction valve (32, 4) opens and air is sucked into the compression space (3). The air flows from the suction connection into the first suction chamber (25), disperses itself therein and, at the same time, acts on the pot-shaped part (79, 80) which delimits the first suction chamber (25). From the first suction chamber (25), the air then goes through the passage opening (78) of the pot-shaped part (79, 80) and into the second suction chamber (31), in which it dispenses again and thereby acts on the area of the pot-shaped part (79, 80) delimiting the second suction chamber (31). The air then enters the compression space (3) through the open suction valve (32, 4).

During the following compression stroke of the piston (2), the suction valve (32, 4) closes and the pressure valve (5, 7) reaches its open position. The compressed air goes through the open pressure valve (5, 7), into the first pressure chamber (10), and acts on the area of the plate (76) delimiting the first pressure chamber (10). The stream of compressed air reaching the plate (76) is deflected by said plate (76) and goes through the passage opening (77), located in the area of the pressure space (10, 17) in the plate (76), and then proceeds into the second pressure chamber (17). As in the first pressure chamber (10), the compressed air is dispersed in the second pressure chamber (17) and then reaches the compression connection (18) through which it emerges and reaches a consumer through a pressure fluid line (not shown) connected to the pressure connection (18).

The compressed air in the first pressure chamber (10) remains in the first pressure chamber (10) for a certain time. The amount of time is determined by the plate (76) in the form of a separating element, and by the relatively small passage cross-section of the passage opening (77) in the seal (12). Because of the relatively small passage cross-section of the passage opening (77), the heat, which is mainly produced by the compressed air, is transferred efficiently by the plate (76).

Due to the placement of the wall-like parts (76, 79, 80) used as separating elements in the cylinder head, a forced path of the sucked air and of the compressed air can be prescribed. The compressed air in the pressure space (10, 17) can be guided purposefully and efficiently to well-cooled locations in the cylinder head (33, 29). The wall-like parts (76, 79, 80) are provided with passage openings (77, 78) in the area of the pressure space (10, 17) and in the suction space (31, 25). The wall-like parts are also provided with passage openings (77, 78) in the area of other additional spaces, e.g., in a compressor with auto-stabilization. If the plate (76) serving as a separating element is connected via a connecting element to the valve catcher (8) of the pressure valve (5, 7), heat transfer can be further improved. Thanks to the placement of at least one of the described wall-like elements in the cylinder head the temperature at the pressure connection piece of the compressor is considerably lower than in known compressors.

Figure 3:
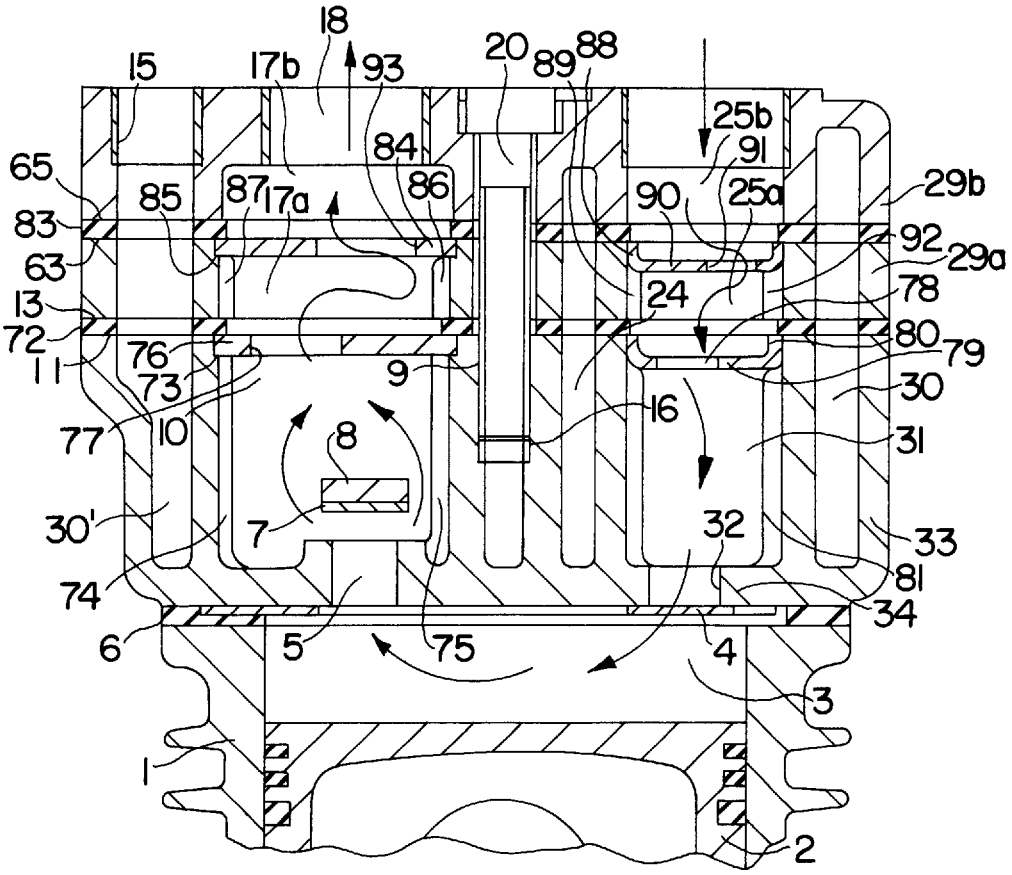
FIG. 3 shows a longitudinal section through the cylinder head which is provided with two plate-shaped parts subdividing the pressure space and the suction space.

FIG. 3 shows the cylinder head of a compressor having essentially the same structure as the cylinder head shown in FIG. 1, with the difference, however, that the upper cylinder head section is divided at a right angle to the longitudinal axis of the cylinder head, and that an additional seal is provided between the faces of the two elements of the upper cylinder head section facing each other. In addition, another wall-like part, extending at a right angle to the longitudinal axis of the cylinder head, and serving as a separating element, is provided in the pressure space as well as in the suction space of the compressor. For the sake of greater clarity, the components corresponding to those shown in FIG. 1 are given the same reference numbers. The components corresponding to those shown in FIG. 1 which were already described, are explained only insofar as this is necessary to understand FIG. 3. The upper cylinder head section is subdivided into a first upper cylinder head section (29*a*) following the lower cylinder head section (33) and a second upper cylinder head section (29*b*) connected to it. The two cylinder head sections (29*a* and 29*b*) are connected to each other, and to the lower cylinder head section (33), by means of screws (20). A second flat seal (83) is clampingly held between the face (63) of the first upper cylinder head section (29*a*) toward the second upper cylinder head section (29*b*), and the face (65) of the second upper cylinder head section (29*b*) toward the first upper cylinder head section (29*a*). The second flat seal (83) is provided with openings in the area of the pressure space, the suction space, and the coolant spaces (30, 24, 30') which uncover these spaces.

On its side towards the second upper cylinder head section (29*b*), the wall of the first upper cylinder head section (29*a*) delimiting the second pressure chamber (17) of the pressure space (10, 17), is provided with a surrounding shoulder (85) and with several projections in the form of ribs (86, 87) which are flush with the shoulder (85). The ribs (86, 87) extend in the direction of the longitudinal axis of the cylinder head (29, 33) and reach, at a right angle to the longitudinal axis of the cylinder head (29, 33), into the pressure space. A wall-like part, constituted by an additional plate (84), lies on the shoulder (85) and on the face towards the second upper cylinder head section (29*a*) of the ribs (86, 87) which are flush with the shoulder (85). The thickness of the plate (84) is selected so that, with its side towards the second upper cylinder head section (29*b*), it is either flush with the face (63) towards the second upper cylinder head section (29*b*) of the first upper cylinder head section (29*a*), or extends slightly beyond this face (63). Because of the shoulder (85) and because the outer diameter of plate (84) is greater than the diameter of the pressure space (10, 17), the border area of the plate (84) is covered by a portion of the second flat seal (83). In this manner, the plate (84) is held on the shoulder (85) of the wall of the first upper cylinder head section (29*a*), which delimits the pressure space (10, 17) after connection of the first upper cylinder head section (29*a*) and the second upper cylinder head section (29*b*) to each other, with the flat seal (83) being pre-stressed. The additional plate (84) subdivides the second pressure chamber (17) of the pressure space (10, 17) into a first chamber section (17*a*) and a second chamber section (17*b*). The first chamber section (17*a*) is delimited by the plate (76) and the additional plate (84). The second chamber section (17*b*) is delimited by the additional plate (84) and the second upper cylinder head section (29*b*). In a similar manner, the first suction chamber (25) of the suction space (25, 31) is divided into a first chamber section (25*a*) and a second chamber section (25*b*) by an additional pot-shaped part (90, 88) which constitutes an additional wall-like part. The first chamber section (25*a*) is delimited by the pot-shaped part (79, 80) and by the additional pot-shaped part (90, 88). The second chamber section (25*b*) is delimited by the additional pot-shaped part (90, 88) and by the second upper cylinder head section (29*b*).

The additional pot-shaped part (90, 88) is provided with a bottom (90) and a casing (88). It is positioned in the suction space (25, 31) so that it lies with the outer border area of its bottom (80) on the face of ribs (89, 92) towards the second upper cylinder head section (29*b*). These ribs extend in the direction of the longitudinal axis of the cylinder head (29, 33) and are installed on the wall of the first upper cylinder head section (29*a*) delimiting the suction space. These ribs (89, 92) are at a right angle to the longitudinal axis of the cylinder head (29, 33) and reach into the suction space (25, 31).

The casing (88) of the additional pot-shaped part (90, 88) section (29*b*) presses with its outer surface against the wall of the first upper cylinder head section (29*a*) delimiting the suction space. The face of the casing (88) of the additional pot-shaped part (90, 88) away from the bottom (90) extends towards the second upper cylinder head section (29*b*). It is either flush with the face (63) of the first upper cylinder head section (29*a*) towards the second upper cylinder head section (29*b*) or it extends slightly beyond this face (63). The flat seal (83) is designed in the area of the suction space (25, 31) so that it extends into it to a certain extent, and covers the face of the casing (88) of the pot-shaped part (90, 88) towards itself. In this manner, the additional pot-shaped part (90, 88) is also held on the face of the ribs (89, 92) once the first upper cylinder head section (29*a*) has been connected to the second upper cylinder head section (29*b*) while the flat seal (83) is prestressed.

The first chamber section (17*a*) of the pressure space (10, 17) is connected to the second chamber section (7*b*) of the pressure space (10, 17) by a passage opening (93) provided in an additional plate (84). Similarly, the first chamber section (25*a*) of the suction space (25, 31) is connected to the second chamber section (25*b*) of the suction space (25, 31) by a passage opening (91) in the bottom (90) of the additional pot-shaped part (90, 88). The passage openings (77) provided in the plate (76), which are located in the pressure space (10, 17) and the passage openings (93), which is provided in the additional plate (84) and located in the pressure space (10, 17), are offset in relation to each other. Similarly, the passage opening (78) in the pot-shaped part (79, 80), located in the suction space (31, 25), and the passage opening (91) in the additional pot-shaped part (90, 88), located in the suction space (31, 25), are offset in relation to each other.

During a suction stroke of the piston (2) of the compressor, air passes from the suction connection into the chamber section (25*b*) of the first suction chamber (25). Next, the air passes from the after through the passage opening (91) in the additional pot-shaped part (90, 88) into the chamber section (25*a*) of the first suction chamber (25). From there, the air passes through the passage opening (78) in the pot-shaped part (79, 80) into the second suction chamber (31) of the suction space (31, 25). From here, the air goes through the open suction valve (32, 4) into the compression chamber (3) of the compressor. During the subsequent compression stroke of the piston (2) of the compressor, the compressed air flows through the pressure valve (5, 7) into the first pressure chamber (10). It goes from there through the passage openings (77) provided in the plate (76) into the first chamber section (17*a*). It continues from there through the passage opening (93) provided in the additional plate (84) into the second chamber section (7*b*) of the pressure space (10, 17). From there it passes through the pressure connection (18) and into a pressure line connected to a consumer.

It is, of course, also possible to divide the lower cylinder head section at a right angle to the longitudinal axis of the cylinder head and then to provide either an additional plate, or an additional pot-shaped part between the two lower cylinder head sections. It, or they, would then subdivide the pressure chamber or the suction chamber located in the lower cylinder head section into chamber sections which would then be connected to each other via the passage openings in this plate or in this pot-shaped part.

Figure 4:
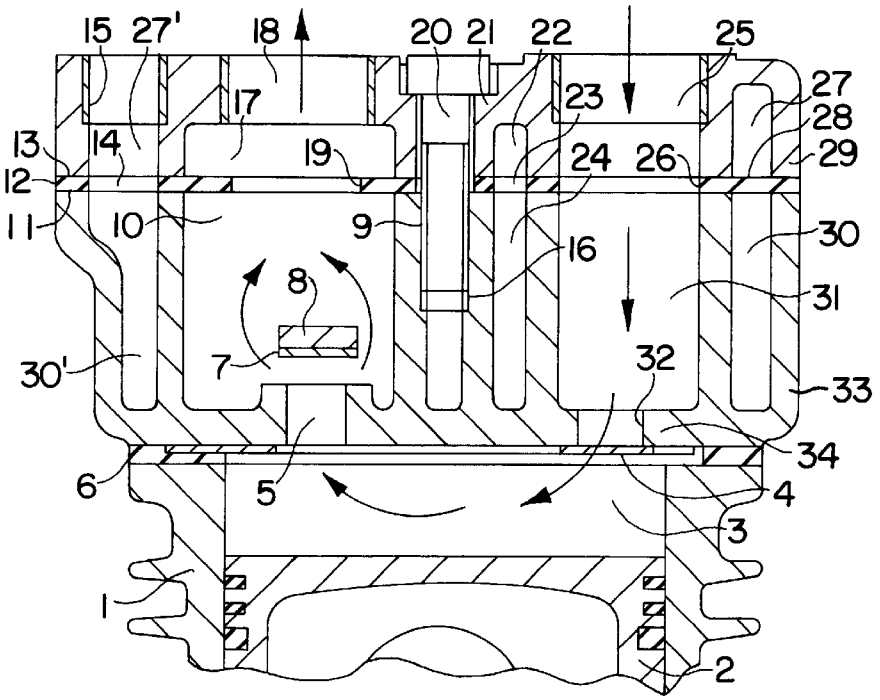
FIG. 4 shows a longitudinal section through the cylinder head of a compressor containing an arrangement of seals according to the present invention, whereby the seal divides the pressure space as well as the suction space each into a first chamber and into a second chamber.

FIG. 4 shows a compressor in which the wall-like part serving as a separating element is constituted of a seal made in a special way. This seal is installed between the lower cylinder head section and the upper cylinder head section. It is then no longer necessary to provide a plate or a pot-shaped part in the pressure space or in the suction space of the cylinder head. Since the compressor shown in FIG. 4 is essentially identical in structure as the compressor shown in FIG. 1, the same reference numbers are used for the same components for the sake of greater clarity.

According to FIG. 4, a piston (2) is installed in a cylinder (1) of a compressor for the production of compressed air. The piston (2) is capable of moving in the direction of the longitudinal axis of the cylinder (1). The cylinder (1) has a compression space (3) which is delimited on the one hand by the piston (2) and on the other hand by a cylinder head (33, 29). The cylinder (1) and the cylinder head (33, 29) are connected to each other via connecting means (not shown) such as screws or stud bolts, whereby a cylinder head seal (6) is installed between the sides of cylinder head (33, 29) and cylinder (1) facing each other.

The cylinder head (33, 29) is divided at a right angle to the longitudinal axis of the cylinder (1) to form a lower cylinder head section (33) and an upper cylinder head section (29). The upper cylinder head section (29) serves as a cylinder head cover. The upper cylinder head section (29) and the lower cylinder head section (33) are detachably connected to each other by means of screws (20) which are screwed into threads (16) of the bores (9) in the cylinder head (33, 29). The side of the lower cylinder head section (33) toward the cylinder has a bottom (34) in which a first passage (32) and a second passage (5) are provided. The first passage (32), together with an elastic tongue-like element serving as a valve closing element (4) that is clampingly held at one end between cylinder (1) and lower cylinder head section (33), constitute a suction valve (32, 4) through which the compression space (3) can be connected to a suction space (31, 25) located in the cylinder head (33, 29). The second passage (5), together with a valve closing element (7), constitute a pressure valve (5, 7) through which the compression space (3) can be connected to a pressure space (10, 17) located in the cylinder head. The valve closing element (7) of the pressure valve (5, 7) is located in the pressure space (10, 17). The opening stroke of the valve closing element (7) of the pressure valve (5, 7) is limited by a valve catcher (8), which is also located in the pressure space (10, 17). The pressure space (10, 17) and the suction space (31, 25) are separated from each other by means of a wall (21) located in the cylinder head (33, 29). The suction space (31, 25) is connected to the atmosphere by a suction connection (54) installed on the cylinder head (33, 29). The pressure space (10, 17) is connected to a consumer by a pressure connection (18) that is installed on the cylinder head (33, 29).

Coolant spaces (30, 27, 24, 22, 30', 27'), in the form of channels, are provided in the walls of the cylinder head (33, 29) which surround or delimit the pressure space (10, 17) and the suction space (31, 25), such as, e.g., the casing of the cylinder head (33, 29) and the wall (21). These channels are connected to each other and are connected by a coolant connection (15) that is connected to a source of gaseous or fluid coolants. The coolant space (27, 30) and the coolant space (27', 30') are made in the form of a cohesive channel located in the casing of the cylinder head (29, 33).

A wall-like part, in the form of a plate-like seal (12), made of a material which transfers heat efficiently, such as a metal, is clampingly held between the face (11) of the lower cylinder head section (33) towards the upper cylinder head section (29) and the face (13) of the upper cylinder head section (29) towards the lower cylinder head section (33). The plate-like seal (12) subdivides the pressure space (10, 17) into a first pressure chamber (10), located on the pressure valve side in the lower cylinder head section (33), and a second pressure chamber (17), located on the pressure connection side located in the upper cylinder head section (29). Similarly, the suction space (31, 25) is subdivided by the plate-like seal (12) into a first suction chamber (25), located on the suction connection (54) side in the upper cylinder head section (29), and a suction chamber (31), located on the suction valve side in the lower cylinder head section (33).

The first pressure chamber (10) is connected to the second pressure chamber (17) by a first passage opening (19) contained in the seal (12). Similarly the first suction chamber (25) is constantly connected to the second suction chamber (31) by a second passage opening (26) provided in the seal (12). In the same manner, the coolant spaces are subdivided by the plate-like seal (12) into first coolant chambers (30, 24, 30'), located in the lower cylinder head section (33), and second coolant chambers (27', 22, 27), located in the upper cylinder head section (29). The first coolant chamber (30) of the coolant space (30, 27) is connected by a passage opening (28), provided in the seal (12), to its associated second coolant chamber (27). The first coolant chamber (24) of the coolant space (24, 22) is connected by a passage opening (23), provided in the seal (12), to its associated second coolant chamber (22). Finally, the first coolant chamber (30') of the coolant space (30', 27') is connected by a passage opening (14) to its associated second coolant chamber (27').

Figure 5:
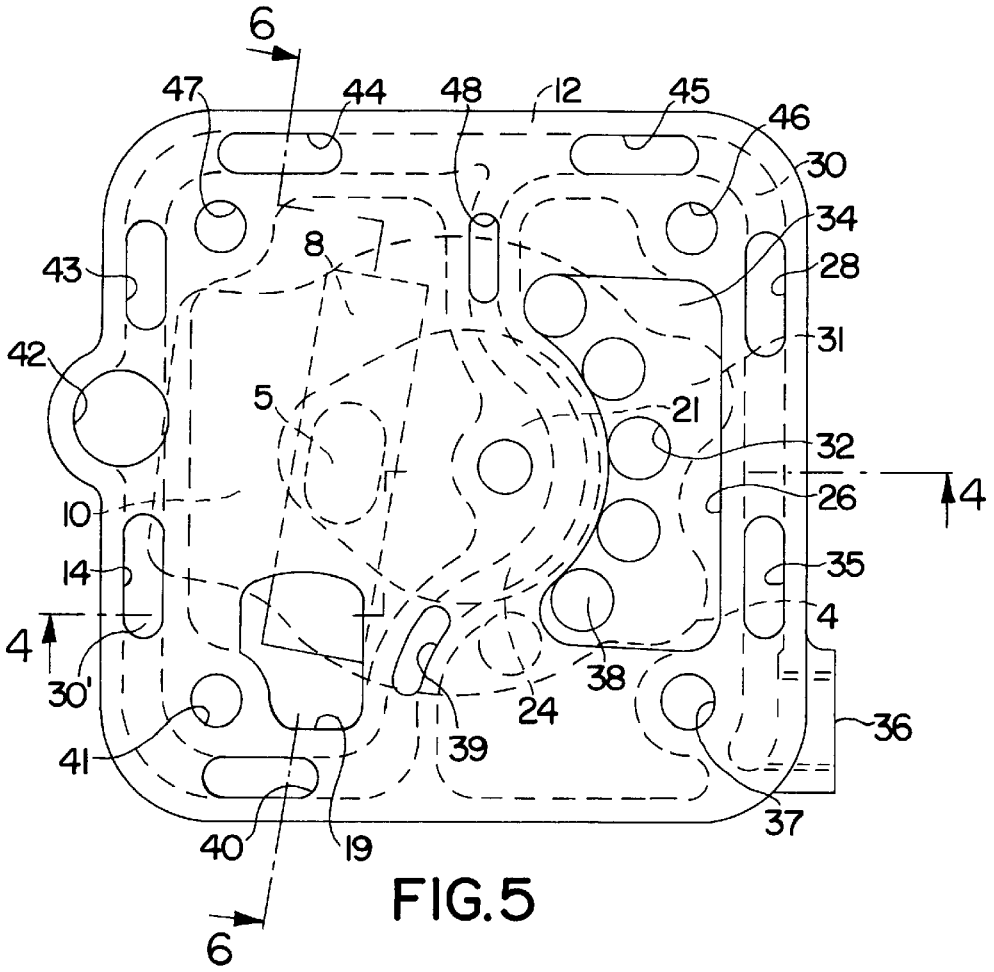
FIG. 5 is a top view of the cylinder head according to FIG. 4 with the upper cylinder head section removed.

FIG. 5 shows a top view of the cylinder head of the compressor of FIG. 4 with the upper cylinder head section removed. For the sake of clarity, the components identical to those shown in FIG. 4 are given the same reference numbers.

The lower cylinder head section is provided with the first pressure chamber (10) and the second suction chamber (31) as well as with the first coolant chambers (30, 24, 30') that are made in the form of channels. As can be seen from the drawings, the passage opening (19) provided in the plate-like seal (12) that connects the first pressure chamber (10) to the second pressure chamber of the pressure space, has a comparatively small passage cross-section. This ensures that the greater part of the first pressure chamber (10) is covered by the plate-like seal (12). The passage opening (5) and the valve catcher (8) of the pressure valve (5, 7) are represented by a broken line in the bottom (34) of the lower cylinder head section (33). The second suction chamber (31), which is also located in the lower cylinder head section, is connected by the passage opening (26) in the seal (12) to the first suction chamber that is located in the upper cylinder head section. The cross-section of the passage opening (26) is considerably larger than that of the passage opening in the pressure space. To avoid intake losses or throttle losses, the cross-section of the passage opening (26) must be at least equally as large or larger than the passage opening of the suction connection (54).

The bottom (34) of the lower cylinder head section (33) has several passage openings (32, 38) which, together with the tongue-like valve closing element (4), constitute the suction valve (32, 38, 4). The first coolant space is in the form of a channel which, in part, surrounds the pressure chamber and the suction chamber. The first coolant space is located in the casing of the cylinder head (33) and is subdivided by the plate-like seal (12). The seal (12) subdivides the coolant channel into the second coolant chamber, located in the upper cylinder head section, and the first coolant chamber (30, 30'), located in the lower cylinder head section (33). The second coolant chamber and the first coolant chamber (30, 30') of the coolant channel are connected to each other by the passage openings (28, 35, 4, 45, 43, 14 and 40) that are located in the seal (12), and to the coolant source by the coolant connection (36) that is connected to these openings. The passage opening (42) located in the seal (12) serves to connect the second coolant chamber in the upper cylinder head section to the first coolant chamber in the lower cylinder head section (33). An additional coolant space, in the form of a coolant channel located in the wall (21) of the cylinder head, is connected to the coolant space contained in the casing of the cylinder head so that these two coolant spaces surround both the pressure space and the suction space as a ring. The additional coolant space, in the form of a coolant channel, is subdivided into the first coolant chamber (24), located in the lower cylinder head section (33), and the coolant chamber, located in the upper cylinder head section. The two coolant chambers of the additional coolant space (24, 22) are connected to each other by passage openings (39 and 48) in the seal (12). Screws (not shown) connecting the cylinder head (29, 33) to the cylinder (1) go through additional passage openings (37, 41, 47 and 46) provided in the seal (12).

Figure 6:
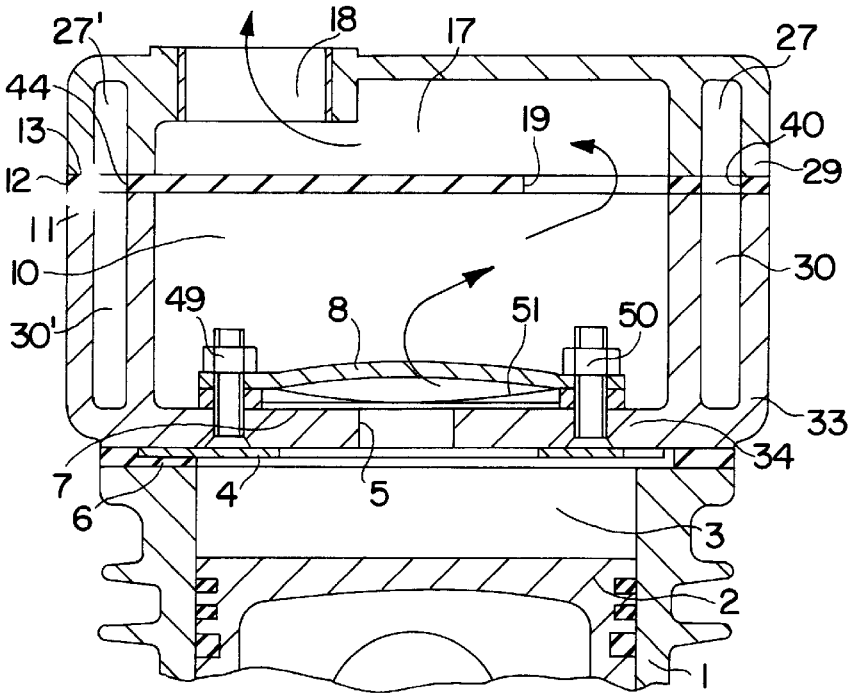
FIG. 6 shows a longitudinal section through the cylinder head along the section line 6—6 of FIG. 5.

The view of the cylinder head shown in FIG. 4 is a section of the cylinder head along section line 4—4 in FIG. 5. FIG. 6 shows a view of the cylinder head described above along section line 3—3 in FIG. 5. For the sake of clarity, the same components in FIG. 6 that are identical with the components shown in FIGS. 4 and 5 are given the same reference numbers.

As shown in FIG. 6, and as described above, the pressure valve consists of a passage opening (5) located in the bottom (34) of the lower cylinder head section (33) and a plate-like valve closing element (7). The plate-like valve closing element (7) is located on the side of bottom (34) away from the compression space (3) and lies on and covers the passage opening (5). The valve closing element (7) is held onto the bottom (34) by a prestressed leaf spring (51). The leaf spring (51) is held at its two ends by means of screws (49 and 50) on the bottom (34 of the lower cylinder head section (34). The same screws also affix the arc-shaped valve catcher (8) by its ends to the bottom (34). The valve catcher (8), which is associated with the pressure valve (5, 7), is placed over the leaf spring (51) and the valve closing element (7) to form an arc that delimits the stroke of the valve closing element (7) in the opening direction of the pressure valve (5, 7).

The passage opening (19) in the area of the seal (12), which subdivides the pressure space (10, 17) into a first pressure chamber (10) and a second pressure chamber (17), is laterally offset relative to the pressure valve (5, 7). This offset is required so that the compressed air emerging from the pressure valve (5, 7) cannot go in a direct path from the first pressure chamber (10) to the second pressure chamber (17) but must first be deflected from the seal (12) that serves as a separating element in the direction of the passage opening (19).

FIG. 6 also clearly shows the passage opening (40) and the passage opening (44) in the area of the seal (12) which subdivides the coolant space (27', 27, 30', 30). The coolant space (27', 27, 30', 30) is made in the form of a channel that is installed in the cylinder head (29, 33) and subdivides the cylinder head into the first coolant chamber (30', 30), located in the lower cylinder head section (33), and the second coolant chamber (27', 27), located in the upper cylinder head section (29).

Figure 7:
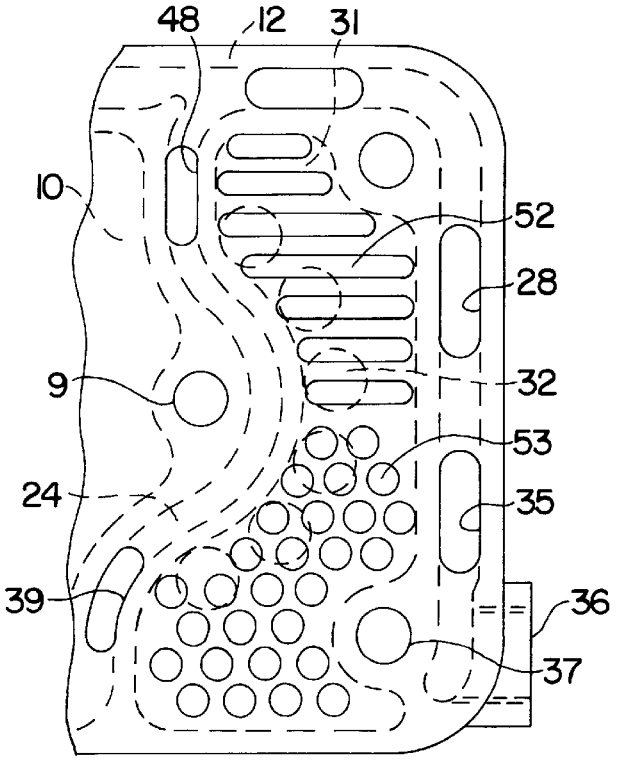
FIG. 7 is a top view of the cylinder head according to FIGS. 4 and 6 with the cylinder head cover removed, whereby the seal has a configuration that is different from the seal shown in FIG. 5.

FIG. 7 shows a detail of the top view of the cylinder head according to FIG. 4 with the upper cylinder head section removed. The seal in FIG. 4 has a configuration in the area of the suction space of the cylinder head that is different from the seal shown in FIG. 1 or FIG. 5. The cylinder head is provided with the plate-like seal (12) which is substantially identical to the seal shown in FIGS. 4–6. In this figure too, the components, passage openings and spaces which are identical with the components, passage openings and spaces shown in FIGS. 4–6 are given the same reference numbers.

Unlike the seal shown in FIG. 5, the area of the plate-like seal (12) that is designed as a separating element, which divides the suction space (31, 25) into a first suction chamber and a second suction chamber, is provided not with one single larger passage opening, but with either a plurality of slits (52) or a plurality of small, circular or oval passage openings (53). These slits (52) or openings (53) serve to connect the second suction chamber (31), located in the lower cylinder head section (33), with the first suction chamber (25), located in the upper cylinder head section (29). The configuration of the passages in the areas of the plate-like seal (12) subdividing the coolant spaces into first and second chambers is the same for the seal shown in FIG. 7 as in FIG. 5. The function of the seal shown in the above figures is explained below in further detail.

During a suction stroke of the piston (2), the suction valve (32, 4) opens and air is sucked into the compression space (3). The air flows from the suction connection (54) into the first suction chamber (25), disperses itself therein and at the same time acts on the area of seal (12) which delimits the first suction chamber (25). From the first suction chamber (25), the air goes through the passage opening (26) in the seal (12) into the second suction chamber (31) in which it divides again and thereby acts on the area of the seal (12) delimiting the second suction chamber (31). The air then enters the compression space (3) through the open suction valve (32, 4).

During the following compression stroke of the piston (2), the suction valve (32, 4) closes and the pressure valve (5, 7) reaches its open position. The compressed air goes through the open pressure valve (5, 7) into the first pressure chamber (10) and influences the area of the seal (12) delimiting the first pressure chamber (10). The stream of compressed air reaching the seal (12), is deflected by said seal (12), goes through the passage opening (19) located in the area of the pressure space (10, 17) in the seal (12), and proceeds into the second pressure chamber (17). As in the first pressure chamber (10), the compressed air is dispersed in the second pressure chamber (17) and then reaches the compression connection (18) through which it emerges and reaches a consumer (not shown) through a compressed fluid line connected to the pressure connection (18) (not shown).

The compressed air in the first pressure chamber (10) remains in the first pressure chamber (10) for a certain time. The amount of time is determined by the size of the passage cross-section of the passage opening (19) in the seal (12). Because of the relatively small passage cross-section of the passage opening (19), the heat, which is mainly produced by the compressed air, is transferred efficiently by the seal (12).

Since the seal (12) extends not only into the pressure space (10, 17) but also into the suction space (31, 25) as well as the coolant spaces (30, 30'; 27, 27'; and 24, 24'), the heat is transferred to the coolant and towards the area of the seal (12) cooled by the sucked air.

Because the seal (12) is in the form of a plate-like separating element that is located between the upper cylinder head section (29) and the lower cylinder head section (33), and is provided with passage openings (28, 35, 40, 14, 43, 44, 45, 48, 39) in the areas of the coolant spaces (30, 30', 27, 27', 24, 22), a forced path of the sucked air, of the compressed air and also of the coolant can be prescribed. The compressed air in the pressure space (10, 17) can be guided purposefully to well-cooled locations in the cylinder head (33, 29). The seal (12) can also be provided with passage openings in additional spaces, e.g., in a compressor with autostabilization, for enhanced cooling capability. If the seal (12) is connected by a connecting element to the valve catcher (8) of the pressure valve (5, 7) heat transfer can be further improved. Thanks to the placement of the described seal in the cylinder head, the temperature at the pressure connection piece of the compressor is considerably lower than in known compressors. If the compressor is provided with a suction connection on the side of the cylinder head, an additional rib is provided on the seal as shown in FIG. 5.

Figure 8:
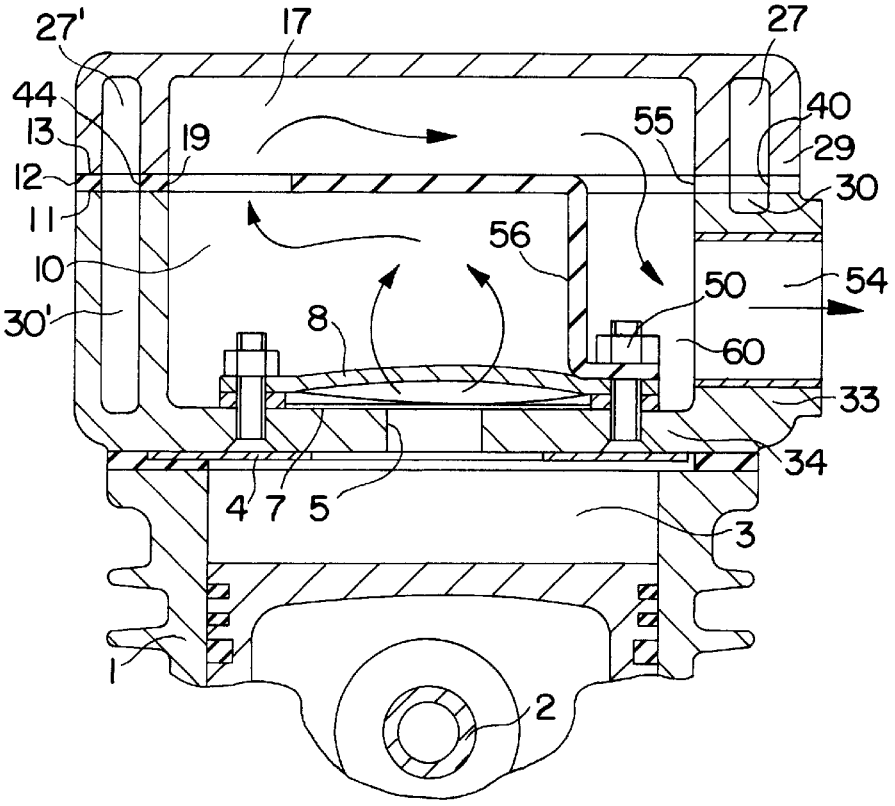
FIG. 8 shows a longitudinal section through the cylinder head of a compressor containing the arrangement of seals according to the present invention, with a suction connection provided on the side of the cylinder head.

FIG. 8 shows the same view of the cylinder head as FIG. 6. Since the cylinder head shown in FIG. 8 is essentially of identical construction as the cylinder head shown in FIGS. 4 and 6, the components which are identical with the components shown in FIGS. 4 and 6 are given the same reference numbers. Since the cylinder head has already been described in detail above, only the modified design of the seal between the lower cylinder head section and the upper cylinder head section will be discussed here.

The suction connection (54) on the compressor, according to FIG. 8, is located laterally at the lower cylinder head section (33). The seal (12) is held clampingly between the lower cylinder head section (33) and the upper cylinder head section (29) and subdivides the pressure space (10, 17) into the first pressure chamber (10) and the second pressure chamber (17). The seal (12) also subdivides the suction space into the first suction chamber and the second suction chamber, and the coolant spaces (27, 30, 27', 30') into first coolant chambers (30, 30') and second coolant chambers (27, 27'). The first passage opening (19) provided in the plate-like seal (12) serves to connect the first pressure chamber (10) to the second pressure chamber (17).

The seal (12) is provided with a rib-like part (56) which runs at a right angle to the longitudinal axis of the seal (12) away from said seal (12) and extends in the direction of the bottom (34) of the lower cylinder head section (33). The free end of the rib-like part (56) is offset at 90°, with the 90° offset portion being connected to the pressure valve (5, 7) by means of the screw (50) holding the valve catcher (8) of the pressure valve (5, 7). The rib-like part (56) is installed on the seal (12) between the pressure valve (5, 7) and the pressure connection (54). The rib-like part (56), together with the seal (12), separates the first pressure chamber (10) from a third pressure chamber (60). The third pressure chamber (60) is connected by an additional passage opening (55), located in the seal (12), to the second pressure chamber (17).

Thanks to this design and arrangement of the seal (12), the compressed air flowing from the compression space (3) is deflected through the pressure valve (5, 7) and into the first pressure chamber (10) during a conveying stroke of the piston (2). The compressed air flows through the first passage opening (19), which is offset laterally in the seal (12) relative to the pressure valve (5, 7), and into the second pressure chamber (17). The compressed air is again deflected by the seal (12) and by the upper cylinder head section (29) and continues through the additional passage opening (55) in the seal (12) into the third pressure chamber (60) of the pressure space (10, 17, 60). From there, the compressed air flows through the pressure connection (54) and through a pressure fluid line (not shown) to a consumer. The dwell time of the compressed air in the pressure space (10, 17, 60) is extended by the measure described above so that, in a combined effect of the compressed air, the large surfaces of the seal (12) and of the rib-like part (56), efficient heat transfer from the pressure space (10, 17, 60) to the coolant spaces (30, 30', 27, 27') and to the cylinder head casing is achieved. Due to the fact that the seal (12) is connected by the rib-like part (56) to the valve catcher (8) of the pressure valve (5, 7), any intense heat that develops at the pressure valve (5, 7) is also transferred efficiently.

Figure 9:
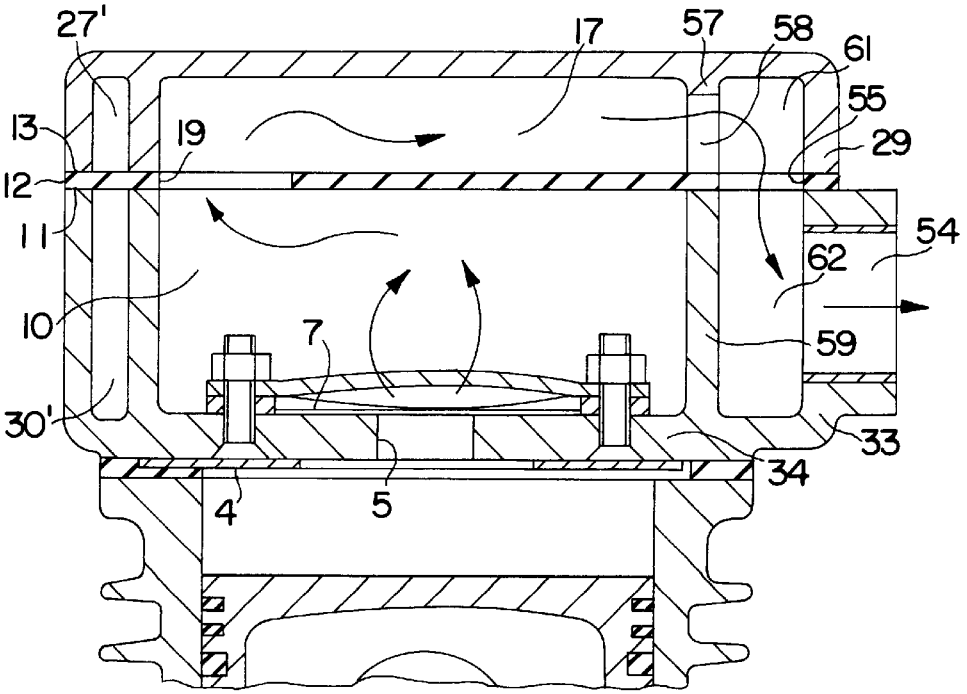
FIG. 9 shows an embodiment of the cylinder head with lateral pressure connection that is different from the design of the cylinder head shown in FIG. 8.

As shown in FIG. 9, it is possible to omit the rib-like part at the seal and to provide a first rib-like part (59) between the pressure valve (5, 7) and the pressure connection (54) on the bottom (34) of the lower cylinder head section (33). The rib-like part (59) extends away from the bottom (34) in the direction of the plate-like seal (12) and either reaches with its free end to close proximity of the seal (12), or presses with its free end against the seal (12). A second rib-like part (57) is installed on the upper cylinder head section (29) across from the first rib-like part (59). The second rib-like part (57) extends away from the upper cylinder head section (29) in the direction of the plate-like seal (12) and either reaches with its free end into close proximity of the seal (12) or presses with its free end against the seal (12). Through this measure, the pressure space is subdivided into the first pressure chamber (10), the second pressure chamber (17), the third pressure chamber (61) and a fourth pressure chamber (62). The first pressure chamber (10) is connected by the first passage opening (19) located in the seal (12) to the second pressure chamber (17). The second pressure chamber (17) is connected by a second passage opening (58) in the second rib-like part (57) to the third pressure chamber (61). The third pressure chamber (61) is connected by an additional passage opening (55) in the seal (12) to the fourth pressure chamber (62).

During a conveying stroke of the piston (2), the compressed air that emerges through the pressure valve (5, 7) from the compression space (3) flows through the first pressure chamber (10) to the second pressure chamber (17). From the second pressure chamber (17), the compressed air flows to the third pressure chamber (61). From the third pressure chamber (61), the compressed air flows to the fourth pressure chamber (62) and on into the pressure connection (54) which is connected to a consumer by a pressure fluid line (not shown).

Due to the repeated deflection of the compressed air in the pressure space (10, 17, 61, 62) caused by the seal (12), the rib-like parts (57 and 59), and the offsetting of the passage openings (19 or 8 or 55), the dwell time of the compressed air in the pressure space (10, 17, 61, 62) is extended. Through the combination of the large surfaces of the seal (12) and the rib-like parts (57 and 59), efficient heat transfer in the pressure space to the coolant spaces (30, 30', 27, 27') and to the cylinder head casing is achieved.

The temperature at the pressure connection of the compressor, or the pressure connection piece, is reduced more with the seal designed in accordance with the present invention than with known compressors. The placement of the passage openings (19, 58, 55, 23, 14, 28) in the seal (12) and in the rib-like parts (57, 59 or 56), as well as the form of these passage openings and rib-like parts, are of course not limited to the examples of embodiments shown in the drawings. For example, the passage openings may also be delimited by an edge of the seal (12) and by a wall of the cylinder head.

Figure 10:
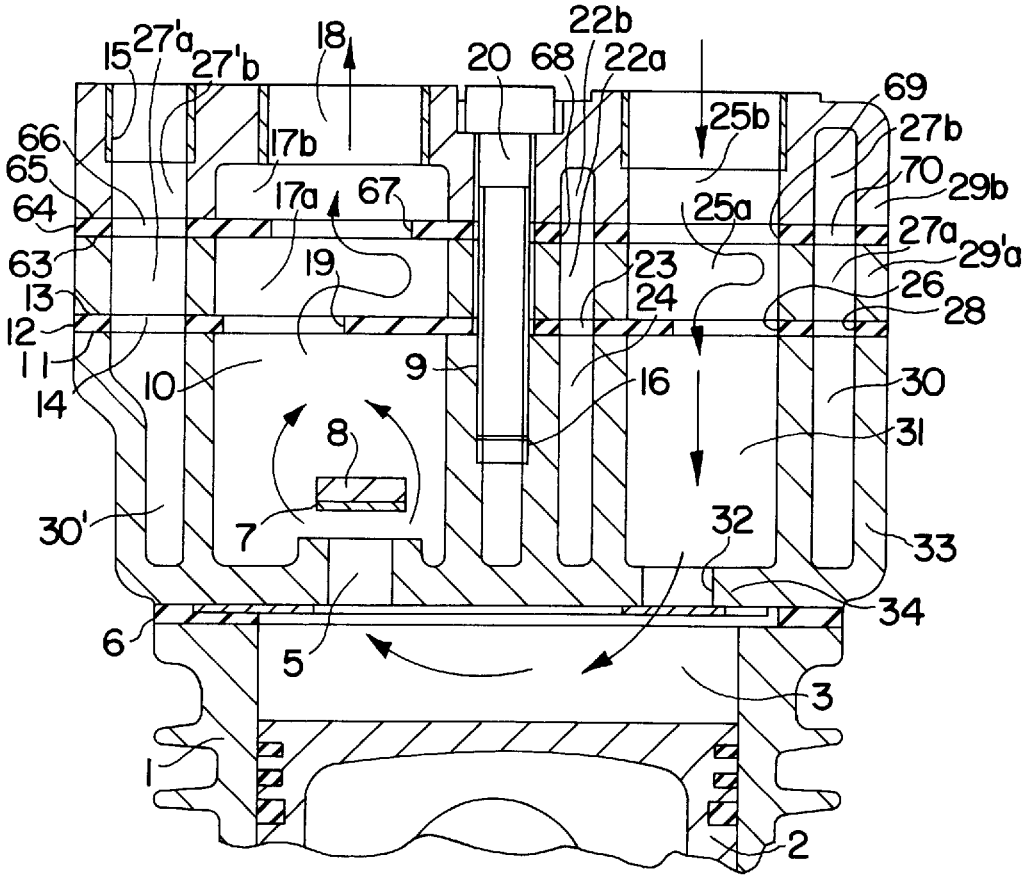
FIG. 10 shows a longitudinal section through a cylinder head with two plate-shaped seals.

FIG. 10 shows the cylinder head of a compressor with essentially the same structure as the cylinder head shown in FIG. 4. In this embodiment, the upper cylinder head section is divided at a right angle to the longitudinal axis of the cylinder head. A second seal is placed between the faces of the two parts of the upper cylinder head section facing each other. For the sake of clarity, the components corresponding to the components shown in FIG. 4 are given the same reference numbers.

The upper cylinder head section is subdivided into a first upper cylinder head section (29*a*) following the lower cylinder head section (33) and a second upper cylinder head section (29*b*) connected to it. The two cylinder head sections (29*a* and 29*b*) are connected to each other and to the lower cylinder head section (33) by means of screws (20). A second plate-like seal (64), made of a material which transfers heat efficiently, e.g., a metallic material, is clampingly held between the face (63) of the first upper cylinder head section (29*a*) toward the second upper cylinder head section (29*b*) and the face (65) of the second upper cylinder head section (29*b*) toward the first upper cylinder head section (29*a*). The plate-like second seal (64) subdivides the second pressure chamber of the pressure space into a first chamber section (17*a*) and a second chamber section (17*b*). The first chamber section (17*a*) is delimited by the first seal (12) and the second seal (64). The second chamber section (17*b*) is delimited by the second seal (64) and the second upper cylinder head section (29*b*). Similarly the first suction chamber of the suction space is subdivided by the plate-like second seal (64) into a first chamber section (25*a*) and a second chamber section (26*b*). The first chamber section (25*a*) is delimited by the first seal (12) and by the second seal (64). The second chamber section (25*b*) is delimited by the second seal (64) and the second upper cylinder head section (29*b*). The first chamber section (17*a*) is connected to the second chamber section (17*b*) by a first passage opening (7) provided in the second seal (64). Similarly the first chamber section (25*a*) is connected to the second chamber section (25*b*) of the suction space by a second passage opening (69) provided in the second seal (64). The passage opening (19), located in the pressure space (10, 17*a*, 17*b*) in the first seal (12), and the passage opening (66), located in the pressure space (10, 17*a*, 17*b*) in the second seal (64), are offset relative to each other. In the same manner, the passage opening (28) located in the suction space (31, 25*a*, 25*b*) in the first seal (12), and the passage opening (69) located in the suction space (31, 35, 35*b*) in the second seal (64), are offset relative to each other. The coolant chambers, located in the upper cylinder section, are also subdivided by the second plate-like seal (64) into first chamber sections (27*a*, 22*a*, 27'*a*) and second chamber sections (27*b*, 22*b*, 27'*b*). The first chamber section (27*a*) of the coolant chamber (27*a*, 27*b*) is connected by a passage opening (70), located in the second seal (64), to its associated second chamber section (27*b*). The first chamber section (22*a*) of the coolant chamber (22*a*, 22*b*) is connected by a passage opening (68), located in the second seal (64), to its associated second chamber section (22*b*). The first chamber section (27'*a*) of the coolant chamber (27'*a*, 27*b*) is connected by a passage opening (66), located in the second seal (64), to its associated second chamber section (27'*b*).

As can be seen from the above description, the first plate-like seal (12) is clampingly held between the lower cylinder head section (33) and the first section (29*a*) of the upper cylinder head section (29*a*, 29*b*). The second seal (64) is clampingly held between the first section (29*a*) and the second section (29*b*) of the upper cylinder head section (29*a*, 29*b*). The passage openings (28, 23 and 14), located in the coolant chambers of the cylinder head (33, 29*a*) in the first seal (12), as well as the passage openings (70, 68 and 66) located in these coolant spaces in the second seal (64), are also respectively offset in relation to each other.

During the suction stroke of the piston (2), the air flows from the suction connection (54) into the chamber section (25*b*), from the latter through the passage opening (69) in the second seal (64) into the chamber section (25*a*). From there, the air flows through the passage opening (26) in the first seal (12) into the second suction chamber (31) of the suction space (31, 25*a*, 25*b*). From the suction space (31, 25*a*, 25*b*), the air flows through the open suction valve (32, 4) into the compression space (3) of the compressor. During the following compression stroke of the piston (2), the compressed air flows through the pressure valve (5, 7) into the first pressure chamber (10), through the passage opening (19) in the first seal (12), into the first chamber section (17*a*). From the first chamber section (17*a*), the compressed air flows through the passage opening (67) in the second seal (64) into the second chamber section (17*b*) of the pressure space (10, 17*a*, 17*b*). Finally, the air flows through the pressure connection (18), and into a pressure line connected to a consumer (not shown).

It is of course possible to design the lower cylinder section so as to be divided at a right angle to the longitudinal axis of the cylinder head and then to install a second or additional plate-like seal between the two lower cylinder head sections. In this embodiment, the plate-like seal subdivides the suction chamber, pressure chamber and coolant chambers located in the lower cylinder section into chamber sections which are then connected to each other through passage openings provided in this seal.

It is a significant feature of the present invention that the pressure space and/or the suction space and/or other spaces, such as coolant spaces and additional spaces of the cylinder head, may be subdivided into at least two chambers each by a seal which also serves as a separating element. These chambers are connected to each other by at least one of the passage openings provided in the seal per chamber. Preferably, the seal should be made of a material with good heat transfer properties, such as a metallic material like aluminum, steel, etc. The passage openings in the seal, which are located in the pressure space and in the suction space, should be offset relative to the pressure and suction valve of the compressor to enable the deflection of a large amount of air or compressed air. If two substantially parallel seals at a distance from each other are installed in the cylinder head, the passage openings in the first seal are offset relative to the suction valve or the pressure valve. Similarly the passage openings in the first seal and the passage openings in the second seal are then offset relative to each other so that the air or compressed air is conveyed through a labyrinth and the heat can be transferred efficiently over the large surfaces of the seal.

The arrangement of wall-like parts according to the invention can be used with single-cylinder as well as with multi-cylinder compressors.

In FIGS. 1–3 the wall-like parts installed in the pressure space are shown in the form of plates. The wall-like parts installed in the suction space are shown in the form of pot-shaped parts. The wall-like parts may, of course, also have the same configuration for the pressure space and for the suction space, i.e., all plates or all pot-shaped parts for both the suction space and the pressure space. It is, of course, also possible to install a wall-like part only in the pressure space or only in the suction space of the compressor. The configuration of the wall-like part is naturally not tied to the embodiment shown in the drawing, i.e. plate or pot-shaped part. The wall-like part serving as a separating element may be given any other desired shape.

According to the present invention, the wall-like part may be installed either in the lower cylinder head section or in the upper cylinder head section of the compressor. The wall-like part may also be installed in the area between the pressure connection or the suction connection and the interface between the upper cylinder head section and the lower cylinder head section. Finally, the wall-like part may also be installed between the pressure valve or suction valve and the interface between the upper cylinder head section and the lower cylinder head section. The wall-like part is, in all above-mentioned instances, supported on a shoulder of the wall and/or on the face of ribs installed on the wall or projections of different configuration delimiting the pressure space or the suction space and is held on same by the seal.

Instead of the shoulder, the ribs or the projections, it is also possible to use a bushing inserted into the pressure space or into the suction space as a support of the wall-like part. The wall-like part is then supported on a face of the bushing.

The passage opening serving to connect the pressure or suction chambers or chamber sections with each other can be located in the wall-like part or may be delimited by the wall-like part and the wall delimiting the pressure space or the suction space.

We claim:

1. A compressor comprising:

a cylinder head having a longitudinal axis and comprising a lower cylinder head section having a face and an upper cylinder head section having a face, said upper cylinder head section connected to said lower cylinder head section;

a seal installed between said face of said lower cylinder head section and said face of said upper cylinder head section;

a suction space in said cylinder head, said suction space connected to a suction connection of said compressor;

a pressure space in said cylinder head, said pressure space connected to a pressure connection of said compressor;

a suction valve in said cylinder head;

a pressure valve in said cylinder head;

a compression space of said compressor, said compression space connected by said suction valve to said suction space, said compression space further connected by said pressure valve to said pressure space;

a first partition extending into said pressure space at a right angle to said longitudinal axis of said cylinder head to subdivide said pressure space into a first pressure chamber on said pressure valve side and into a second pressure chamber on said pressure connection side; and a passage opening of said first partition connecting said first pressure chamber and said second pressure chamber.

2. The compressor of claim 1 further comprising a second partition extending into said suction space to subdivide said suction space into a first suction chamber on said suction connection side and into a second suction chamber on said suction valve side; and a passage opening of said second partition connecting said first suction chamber and said second suction chamber.

3. The compressor of claim 1 wherein said passage opening of said first partition is located in said first partition.

4. The compressor of claim 1 wherein said passage opening of said first partition is delimited by said first partition.

5. The compressor of claim 2 wherein said passage opening of said second partition is located in said second partition.

6. The compressor of claim 2 wherein said passage opening of said second partition is delimited by said second partition.

7. A compressor as in claim 1, further comprising:

an additional partition installed in said pressure space of said cylinder head, said second partition extending at a right angle to said longitudinal axis of said cylinder head to subdivide said first pressure chamber or said second pressure chamber into a first pressure chamber section and a second pressure chamber section, wherein said first pressure chamber section and said second pressure chamber section are connected by a passage opening of said additional partition.

8. A compressor as in claim 2, further comprising:

a first additional partition located in said pressure space of said cylinder head, said first additional partition extending at a right angle to said longitudinal axis of said cylinder head to subdivide said first pressure chamber or said second pressure chamber into a first pressure chamber section and a second pressure chamber section, wherein said first pressure chamber section and said second pressure chamber section are connected by a passage opening of said first additional partition.

9. A compressor as in claim 8, said compressor further comprising:

a second additional partition located in said suction space of said cylinder head, said second additional partition extending at a right angle to said longitudinal axis of said cylinder head to subdivide said first suction chamber or said second suction chamber of said suction space into a first suction chamber section and a second suction chamber section, wherein said first suction chamber section and said second suction chamber section are connected by a passage opening of said second additional partition.

10. A compressor as in claim 1, wherein said first partition is planar and supported on a shoulder of a wall of said cylinder head.

11. A compressor as in claim 1 wherein said first partition is planar and supported on a projection extending into said pressure space.

12. A compressor as in claim 11 wherein said projection is in the form of a rib of a wall delimiting said pressure space, said rib extending in the direction of said longitudinal axis of said cylinder and having a portion extending at a right angle to said longitudinal axis into said pressure space.

13. The compressor of claim 11 wherein said projection is in the form of a face of a bushing installed in said pressure space.

14. A compressor as in claim 2, wherein said first partition is planar and said second partition is U-shaped, said first and second partitions being supported on shoulders of walls of said cylinder head.

15. A compressor as in claim 2 wherein said first partition is planar and second partition is U-shaped, said partitions being supported on projections extending into said pressure space and said suction space.

16. A compressor as in claim 15 wherein said projections are in the form of ribs of walls delimiting said pressure space and said suction space, said ribs extending in the direction of said longitudinal axis of said cylinder head and having portions extending at right angles to said longitudinal axis into said pressure space and said suction space.

17. The compressor of claim 15 wherein said projections are in the form of faces of bushings installed in said pressure space and said suction space.

18. A compressor comprising:

a cylinder head having a longitudinal axis and comprising a lower cylinder head section having a face and an upper cylinder head section having a face, said upper cylinder head section connected to said lower cylinder head section;

a seal installed between said face of said lower cylinder head section and said face of said upper cylinder head section;

a suction space in said cylinder head, said suction space connected to a suction connection of said compressor;

a pressure space in said cylinder head, said pressure space connected to a pressure connection of said compressor;

a suction valve in said cylinder head;

a pressure valve in said cylinder head;

a compression space of said compressor, said compression space connected by said suction valve to said suction space, said compression space further connected by said pressure valve to said pressure space;

a first partition extending into said suction space at a right angle to said longitudinal axis of said cylinder head to subdivide said suction space into a first suction chamber on said suction valve side and into a second suction chamber on said suction connection side; and a passage opening of said first partition connecting said first pressure chamber and said second pressure chamber.

19. The compressor of claim 18 further comprising a second partition extending into said pressure space to subdivide said pressure space into a first pressure chamber on said pressure connection side and into a second pressure chamber on said pressure valve side; and a passage opening of said second partition connecting said first suction chamber and said second pressure chamber.

20. A compressor comprising:

a cylinder head comprising a lower cylinder section having a face and an upper cylinder section having a face, said upper cylinder section connected to said lower cylinder section;

a first seal between said face of said lower cylinder head section and said face of said upper cylinder head section;

a suction space in said cylinder head, said suction space connected to a suction connection of said compressor;

a pressure space in said cylinder head, said pressure space connected to a pressure connection of said compressor;

a suction valve in said cylinder head;

a pressure valve in said cylinder head;

a compression space of said compressor, said compression space connected by said suction valve to said suction space, said compression space further connected by said pressure valve to said pressure space;

said first seal being a substantially planar part extending from a clamped area between said upper cylinder head section and said lower cylinder head section at a right angle to a longitudinal axis of said upper cylinder head section and said lower cylinder head section, said first seal further extending at least into said pressure space to divide said pressure space into a first pressure chamber on a side of said pressure valve and a second pressure chamber on a side of said pressure connection, said first pressure chamber and said second pressure chamber being connected to each other through a first passage opening in said first seal.

21. Compressor as in claim 20, wherein said upper cylinder head section is subdivided at a right angle to said longitudinal axis of said cylinder head to form a first section having a face and a second section having a face;

said compressor further having a second seal installed between said faces of said first section and said second section of said upper cylinder head section facing each other;

said second seal being a substantially planar element which extends from a location at which it is clampingly held between said first section of said upper cylinder head section and said second section of said upper cylinder head section at a right angle to said longitudinal axis of said upper cylinder head section, said second seal extending into said upper cylinder head section at least into said second pressure chamber located in said upper cylinder head section so that said second pressure chamber is subdivided by said second seal into a first chamber section and a second chamber section, said first chamber section and said second chamber section being connected to each other by a first passage opening in said second seal.

22. Compressor as in claim 20, wherein said first seal is configured and sized so that it extends into said suction space and subdivides said suction space into a first suction chamber on a side of said suction connection and into a second suction chamber on a side of said suction valve, whereby said first suction chamber and said second suction chamber are connected to each other by a second passage opening in said first seal.

23. Compressor as in claim 21, wherein said second seal is configured and sized so that said second seal extends into said first suction chamber and subdivides said first suction chamber into a first chamber section and a second chamber section, whereby said first chamber section and said second chamber section are connected to each other by a second passage opening in said second seal.

24. Compressor as in claim 20, further comprising at least one additional space in said cylinder head in addition to said suction space and said pressure space, wherein said first seal is configured and sized so that said first seal extends into said additional space and subdivides said additional space into a first chamber and a second chamber, whereby said first chamber and said second chamber are connected to each other by an auxiliary passage opening in said first seal.

25. Compressor as in claim 24 wherein said additional space comprises a coolant channel.

26. Compressor as in claim 21, further comprising at least one additional space in said cylinder head in addition to said suction space and said pressure space, wherein said first seal is configured and sized so that it extends into said additional space and subdivides said additional space into a first chamber and a second chamber, whereby said first chamber and said second chamber are connected to each other by an auxiliary passage opening in said first seal; and wherein said second seal is configured and sized so that said second seal extends into said first chamber of said additional space and subdivides said first chamber into a first chamber section and into a second chamber section, whereby said first chamber section and said second chamber section are connected to each other by an auxiliary passage opening in said second seal.

27. Compressor as in claim 20, wherein said first seal is connected by a rib-like part to a valve catcher in proximity to said pressure valve.

28. Compressor as in claim 27, wherein said rib-like part is located between said pressure valve and said pressure connection of said cylinder head and, together with said first seal, separates said first pressure chamber from a third pressure chamber, whereby said third pressure chamber is connected to said second pressure chamber by a supplementary passage opening in said first seal.

29. Compressor as in claim 20, further having:

a bottom of said lower cylinder head section, between said pressure valve and said pressure connection located on a side of said cylinder head, a rib-like part extending away from said bottom of said lower cylinder head section in the direction of said first seal;

an additional rib-like part installed on said upper cylinder head section across from said rib-like part, said additional rib-like part extending away from said upper cylinder head section in the direction of said first seal, said additional rib-like part separating said second pressure chamber located in said upper cylinder head section from a third pressure chamber which is also located in said upper cylinder head section;

said rib-like part separating said first pressure chamber located in said lower cylinder head section from a fourth pressure chamber which is also located in said lower cylinder head section;

said second pressure chamber being connected to said third pressure chamber by a passage opening located in said second rib-like part, and said third pressure chamber being connected to said fourth pressure chamber by a further passage opening in said first seal.

30. Compressor as at claim 20, wherein said first seal is made of a metallic material.

31. Compressor as in claim 20, wherein said first seal is made of a material with good heat transfer properties.

32. Compressor as in claim 20, wherein said first passage opening in said seal is offset relative to said pressure valve.

33. Compressor as in claim 20, wherein said first passage opening in said first seal is offset relative to said suction valve.

34. Compressor as in claim 26, wherein said passage openings contained in said first seal and said passage openings contained in said second seal are offset relative to each other.

35. Compressor as in claim 20, wherein said lower cylinder head section is subdivided at a right angle to said longitudinal axis of said cylinder head to form a first section having a face and a second section having a face;

said compressor further having a second seal installed between said faces of said first section and said second section of said lower cylinder head section facing each other;

said second seal being a substantially planar element which extends from a location at which it is clampingly held between said first section of said lower cylinder head section and said second section of said lower cylinder head section at a right angle to said longitudinal axis of said lower cylinder head section, said second seal extending into said lower cylinder head section at least into said first pressure chamber located in said lower cylinder head section so that said first pressure chamber is subdivided by said second seal into a first chamber section and a second chamber section, said first chamber section and said second chamber section being connected to each other by a first passage opening in said second seal.

* * * * *